US011828023B2

(12) United States Patent
Hsiao

(10) Patent No.: US 11,828,023 B2
(45) Date of Patent: Nov. 28, 2023

(54) PULP TRANSPORTATION SYSTEM

(71) Applicant: Fu-Lin Hsiao, New Taipei (TW)

(72) Inventor: Fu-Lin Hsiao, New Taipei (TW)

( * ) Notice: Subject to any disclaimer, the term of this patent is extended or adjusted under 35 U.S.C. 154(b) by 0 days.

(21) Appl. No.: 17/893,724

(22) Filed: Aug. 23, 2022

(65) Prior Publication Data

US 2023/0148434 A1 May 11, 2023

(30) Foreign Application Priority Data

Nov. 10, 2021 (TW) ..... 110141873

(51) Int. Cl.
*D21D 5/28* (2006.01)

(52) U.S. Cl.
CPC ..... *D21D 5/28* (2013.01)

(58) Field of Classification Search
CPC ..... D21D 5/28
USPC ..... 162/216
See application file for complete search history.

(56) References Cited

U.S. PATENT DOCUMENTS

2012/0296147 A1* 11/2012 Swearingen ..... C02F 9/00 588/318
2019/0093184 A1* 3/2019 Carlson ..... C12P 19/02

OTHER PUBLICATIONS

TW M513896, Kuo, Chien Kuan, Year Nov. 2015, machine translation.*

* cited by examiner

*Primary Examiner* — Mark Halpern
(74) *Attorney, Agent, or Firm* — Michael Best & Friedrich LLP

(57) ABSTRACT

A pulp transportation system is adapted for transporting a pulp among a pulp-supply machine and a plurality of forming machines, and includes a pump unit, a first pipe unit, a second pipe unit and a valve unit. The pump unit is adapted for urging the pulp to flow. The valve unit is operable to control flow of the pulp through the first pipe unit and the second pipe unit, such that the flow of the pulp is convertible between a pulp-supply state, in which the pulp flows out from the pulp supply machine into at least one of the forming machines, and a pulp-return state, in which the pulp flows out from at least one of the forming machines into the pulp supply machine.

15 Claims, 9 Drawing Sheets

PULP TRANSPORTATION SYSTEM

CROSS-REFERENCE TO RELATED APPLICATION

This application claims priority to Taiwanese Invention Patent Application No. 110141873, filed on Nov. 10, 2021.

FIELD

The disclosure relates to a transportation system, and more particularly to a pulp transportation system.

BACKGROUND

Referring to FIG. 1, a conventional pulp tank structure 1 disclosed in Taiwanese Utility Model Patent No. M513896 includes an extraction unit 13, a retrieving unit 14, an injection unit 15, and a pulp-supply tank 10 that is divided into a working area 11 and an overflow area 12. The working area 11 contains a pulp. The overflow area 12 communicates with the working area 11 and is used for containing overflow of the pulp from the working area 11. The extraction unit 13 is used for extracting the overflow of the pulp from the overflow area 12. The retrieving unit 14 stores the overflow of the pulp from the extraction unit 13, and the injection unit 15 transports the overflow of the pulp from the retrieving unit 14 back to the working area 11 so that the overflow of the pulp can be used in the subsequent productions.

However, in order to retrieve the overflow of the pulp, the pulp-supply tank 10 has to be divided into the working area 11 and the overflow area 12. Consequently, the space in the pulp-supply tank 10 can not be fully utilized since part of the space can not serve as the working area 11. In addition, it is necessary for the conventional pulp tank structure to include at least two pumping power sources to respectively serve as the extraction unit 13 and the injection unit 15 so that the pulp can be transported to and from the pulp-supply tank 10, which increases the cost for transportation of the pulp in the conventional pulp tank structure.

SUMMARY

Therefore, an object of the disclosure is to provide a pulp transportation system that can alleviate at least one of the drawbacks of the prior art.

According to the disclosure, the pulp transportation system is adapted for transporting a pulp among a pulp-supply machine and a plurality of forming machines, and includes a pump unit, a first pipe unit, a second pipe unit and a valve unit. The pump unit is adapted for urging the pulp to flow. The first pipe unit is adapted for fluidly communicating with the forming machines, and includes a plurality of first pulp pipes and a plurality of second pulp pipes that are adapted for the pulp to flow therethrough. The first pulp pipes are respectively connected to the forming machines. The second pulp pipes are respectively connected to the forming machines. The second pipe unit is adapted for the pulp to flow therethrough and includes a first pipe, a second pipe, a third pipe and a fourth pipe. The first pipe is adapted for interconnecting a pulp-supply outlet of the pulp-supply machine and the pump unit. The second pipe fluidly communicates the pump unit with the first pulp pipes of the first pipe unit. The third pipe fluidly communicates the pump unit with the second pulp pipes of the first pipe unit. The fourth pipe is adapted for interconnecting a pulp-supply inlet of the pulp-supply machine and the third pipe. The valve unit is operable to control the flow of the pulp through each of the first pulp pipes of the first pipe unit, the flow of the pulp through each of the second pulp pipes of the first pipe unit, the flow of the pulp through the first pipe of the second pipe unit, the flow of the pulp through the second pipe of the second pipe unit, the flow of the pulp through the third pipe of the second pipe unit, and the flow of the pulp through the fourth pipe of the second pipe unit, such that the flow of the pulp is convertible between a pulp-supply state, in which the pulp flows out from the pulp supply machine into at least one of the forming machines, and a pulp-return state, in which the pulp flows out from at least one of the forming machines into the pulp supply machine.

Another object of the disclosure is to provide a pulp transportation system that can alleviate at least one of the drawbacks of the prior art.

According to the disclosure, the pulp transportation system is adapted for transporting a pulp between a pulp-supply machine and at least one forming machine, and includes a pump unit, at least one first pipe unit, a second pipe unit and a valve unit. The pump unit is adapted for urging the pulp to flow. The at least one first pipe unit includes a first pulp pipe and a second pulp pipe. The first pulp pipe is connected to a forming inlet of the at least one forming machine. The second pulp pipe is connected to the first pulp pipe. The second pipe unit is adapted for the pulp to flow therethrough and includes a first pipe, a second pipe, a third pipe and a fourth pipe. The first pipe is adapted for interconnecting a pulp-supply outlet of the pulp-supply machine and the pump unit. The second pipe fluidly communicates the pump unit with the first pulp pipe of the at least one first pipe unit. The third pipe fluidly communicates the pump unit with the second pulp pipe of the at least one first pipe unit. The fourth pipe is adapted for interconnecting a pulp-supply inlet of the pulp-supply machine and the third pipe. The valve unit is operable to control the flow of the pulp through the first pulp pipe of the at least one first pipe unit, the flow of the pulp through the second pulp pipe of the at least one first pipe unit, the flow of the pulp through the first pipe of the second pipe unit, the flow of the pulp through the second pipe of the second pipe unit, the flow of the pulp through the third pipe of the second pipe unit, and the flow of the pulp through the fourth pipe of the second pipe unit, such that the flow of the pulp is convertible between a pulp-supply state, in which the pulp flows out from the pulp supply machine into the at least one forming machine, and a pulp-return state, in which the pulp flows out from the at least one forming machine into the pulp supply machine.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
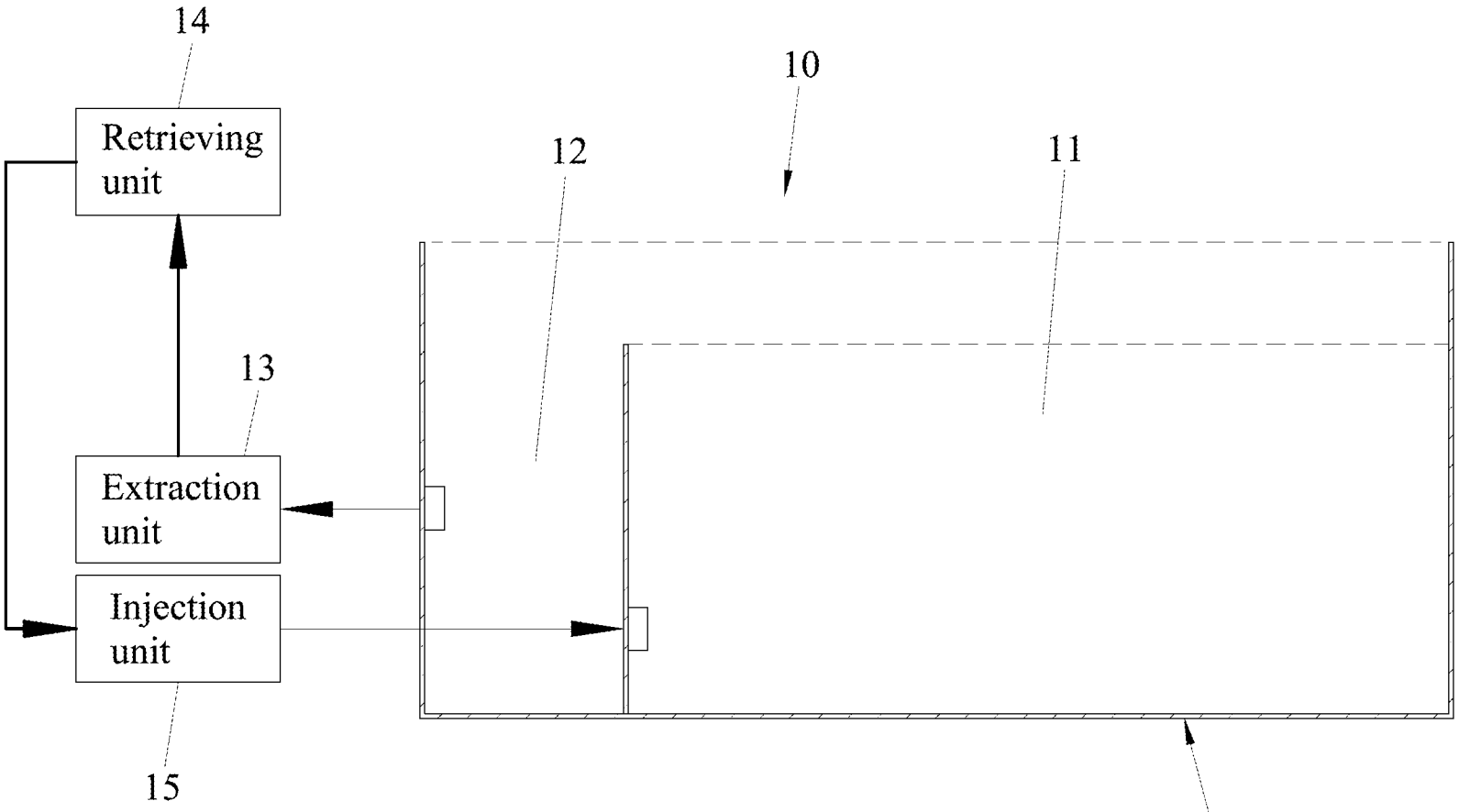
FIG.1 PRIOR ART
FIG. 1 is a schematic view of a conventional pulp tank structure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
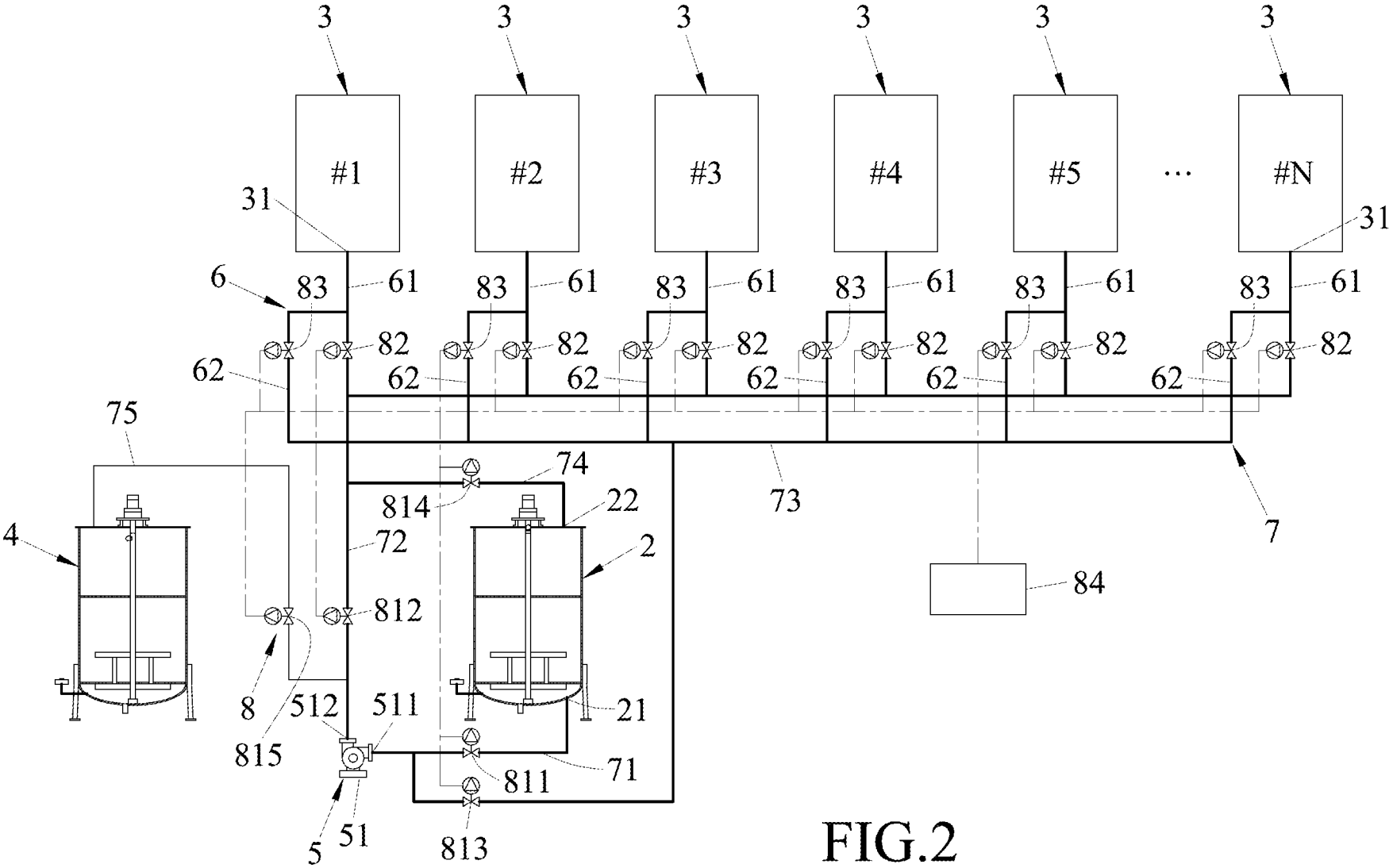
FIG. 2 is a schematic view of a first embodiment of a pulp transportation system according to the disclosure.

Referring to FIG. 2, a first embodiment of a pulp transportation system according to the disclosure is adapted for transporting a pulp among a pulp-supply machine 2, a plurality of forming machines 3 and a waste disposal machine 4. The pulp-supply machine 2 is used for containing the pulp, and has a pulp-supply outlet 21 and a pulp-supply inlet 22. Each of the forming machines 3 is used for the pulp forming process, and has a forming opening 31. In this embodiment, the pulp is configured to be a pulp that will be molded into paper products (e.g., paper sheets, paper cups and paper plates) after the pulp forming process.

The pulp transportation system includes a pump unit 5, a first pipe unit 6, a second pipe unit 7 and a valve unit 8.

The pump unit 5 is adapted for urging the pulp to flow, and includes a first pump 51. The first pump 51 has a pump inlet 511 that is adapted for the pulp to enter the first pump 51, and a pump outlet 512 that is adapted for the pulp to exit the first pump 51.

In this embodiment, the first pump 51 is configured to be a pump that includes a motor converting the electrical energy into kinetic energy.

The first pipe unit 6 is adapted for fluidly communicating with the forming machines 3, and includes a plurality of first pulp pipes 61 and a plurality of second pulp pipes 62 that are adapted for the pulp to flow therethrough. The first pulp pipes 61 are respectively connected to the forming openings 31 of the forming machines 3. The second pulp pipes 62 are respectively connected to the forming machines 3. Specifically, in the first embodiment, the second pulp pipes 62 are respectively connected to the first pulp pipes 61 so that the second pulp pipes 62 are respectively connected to the forming machines 3.

The second pipe unit 7 is adapted for the pulp to flow therethrough, and includes a first pipe 71, a second pipe 72, a third pipe 73, a fourth pipe 74 and a fifth pipe 75.

The first pipe 71 is adapted for interconnecting the pulp-supply outlet 21 of the pulp-supply machine 2 and the pump inlet 511 of the first pump 51 of the pump unit 5 so that the pulp-supply machine 2 fluidly communicates with the first pump 51.

The second pipe 72 interconnects the pump outlet 512 of the first pump 51 and the first pulp pipes 61 of the first pipe unit 6 and fluidly communicates the pump outlet 512 of the first pump 51 with the first pulp pipes 61, so that the first pump 51 fluidly communicates with the forming machines 3.

The third pipe 73 interconnects the first pipe 71 and the second pulp pipes 62 of the first pipe unit 6 so that the third pipe 73 fluidly communicates the pump unit 5 with the second pulp pipes 62 (i.e., the first pump 51 fluidly communicates with the forming machines 3 via the first pipe 71, the third pipe 73, the second pulp pipes 62 and the first pulp pipes 61).

The fourth pipe 74 is adapted for interconnecting the pulp-supply inlet 22 of the pulp-supply machine 2 and the third pipe 73. Specifically, in the first embodiment, the fourth pipe 74 interconnects the second pipe 72 and the pulp-supply inlet 22 of the pulp-supply machine 2, and fluidly communicates with the third pipe 73 via the second pipe 72, the first pump 51 and the first pipe 71. Because the fourth pipe 74 interconnects the second pipe 72 and the pulp-supply machine 2, the pulp-supply machine 2 fluidly communicates with the first pump 51 via the fourth pipe 74 and the second pipe 72.

The fifth pipe 75 interconnects the second pipe 72 and the waste disposal machine 4 so that the fifth pipe 75 fluidly communicates with the waste disposal machine 4 and the first pump 51 (i.e., the first pump 51 fluidly communicates with the waste disposal machine 4 via the second pipe 72 and the fifth pipe 75). The fifth pipe 75 is adapted for fluidly communicating the waste disposal machine 4 with the first pipe 71 and the third pipe 73. Specifically, because the first pump 51 fluidly communicates with the first pipe 71, the third pipe 73 and the second pipe 72, and the fifth pipe 75 fluidly communicates with the waste disposal machine 4 and the first pump 51, the fifth pipe 75 fluidly communicates the waste disposal machine 4 with the first pipe 71 and the third pipe 73.

Figure 3:
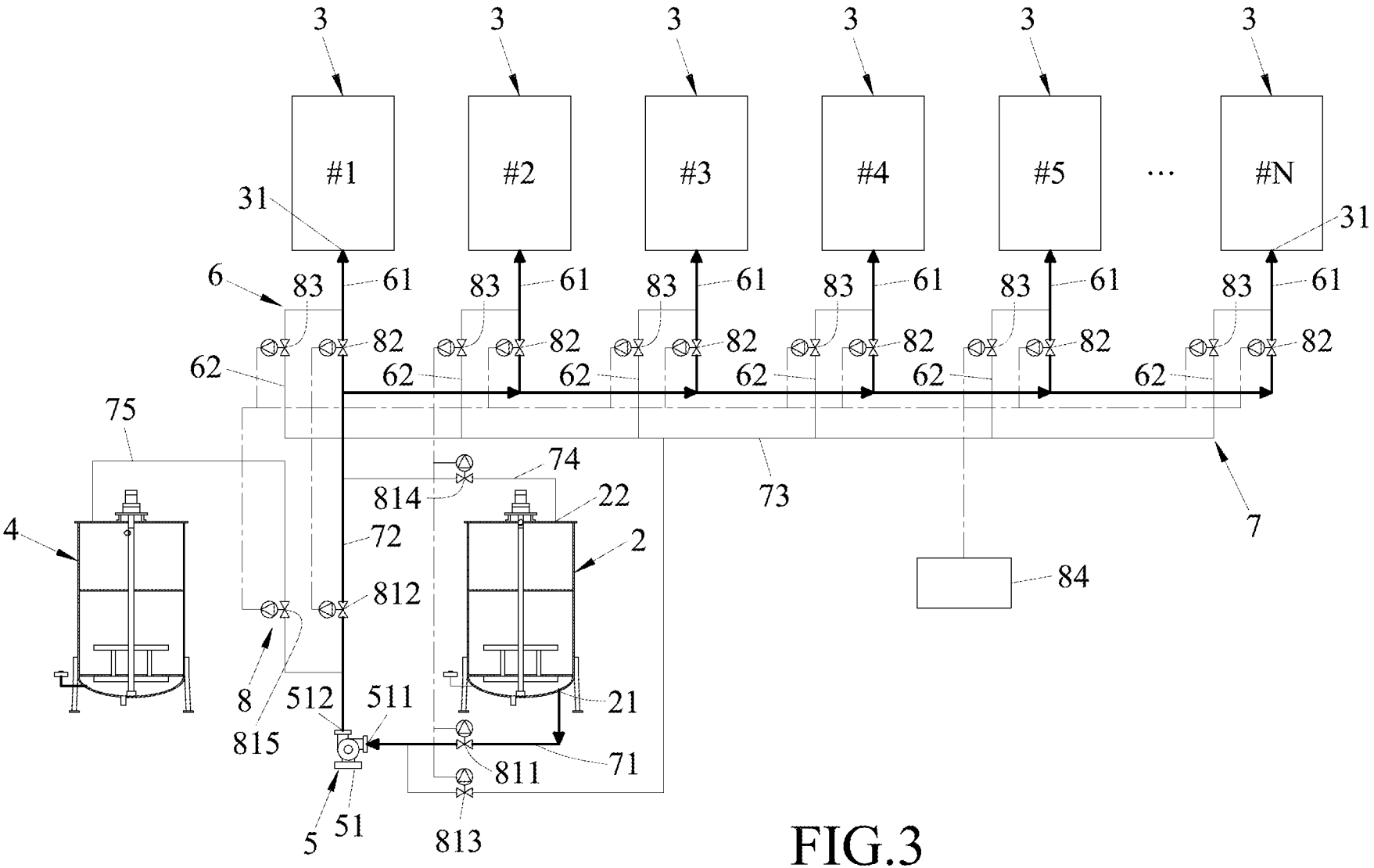
FIG. 3 is a schematic view illustrating the flow of a pulp in the first embodiment in a pulp-supply state.
Figure 4:
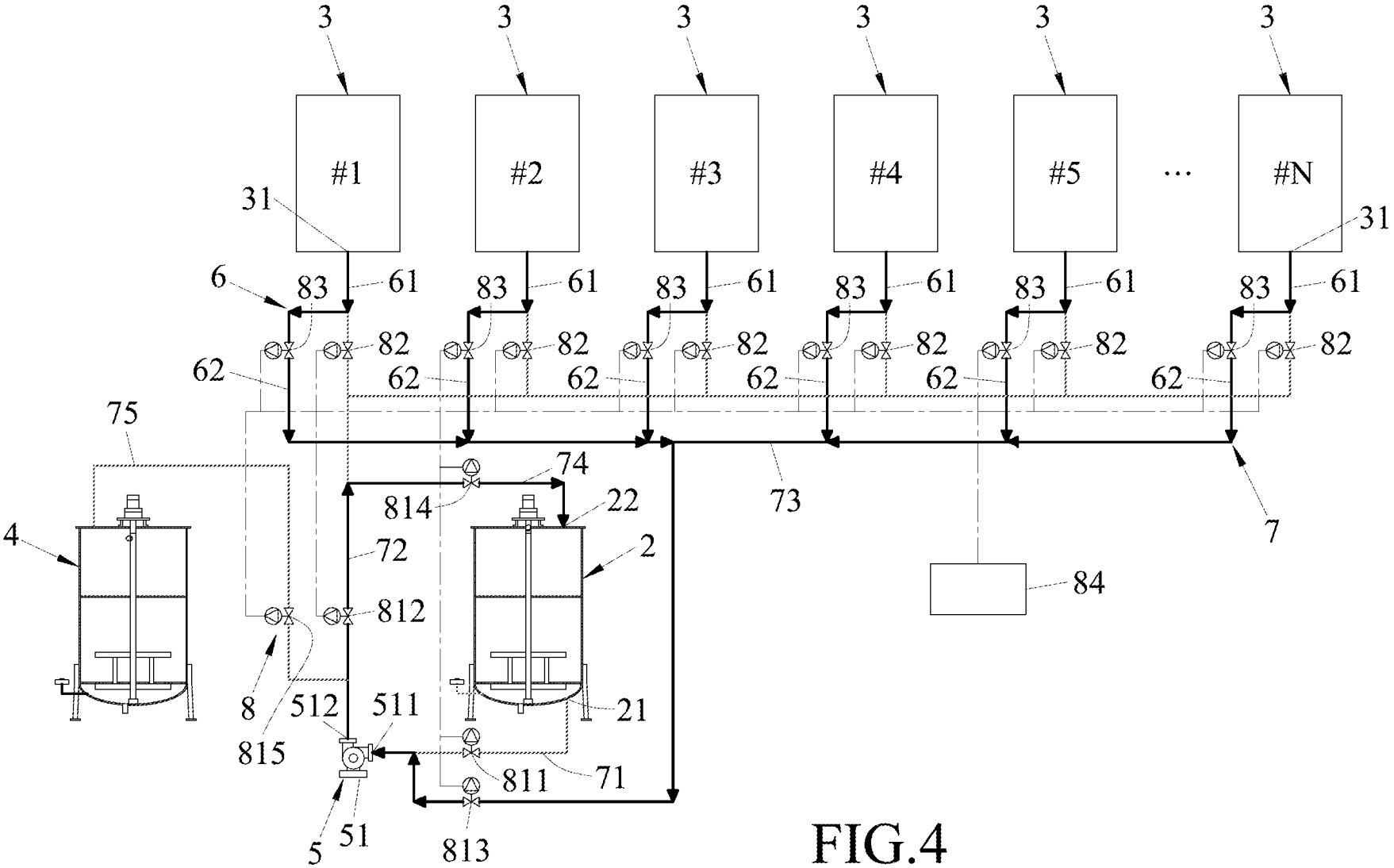
FIG. 4 is a schematic view illustrating the flow of a pulp in the first embodiment in a pulp-return state.
Figure 5:
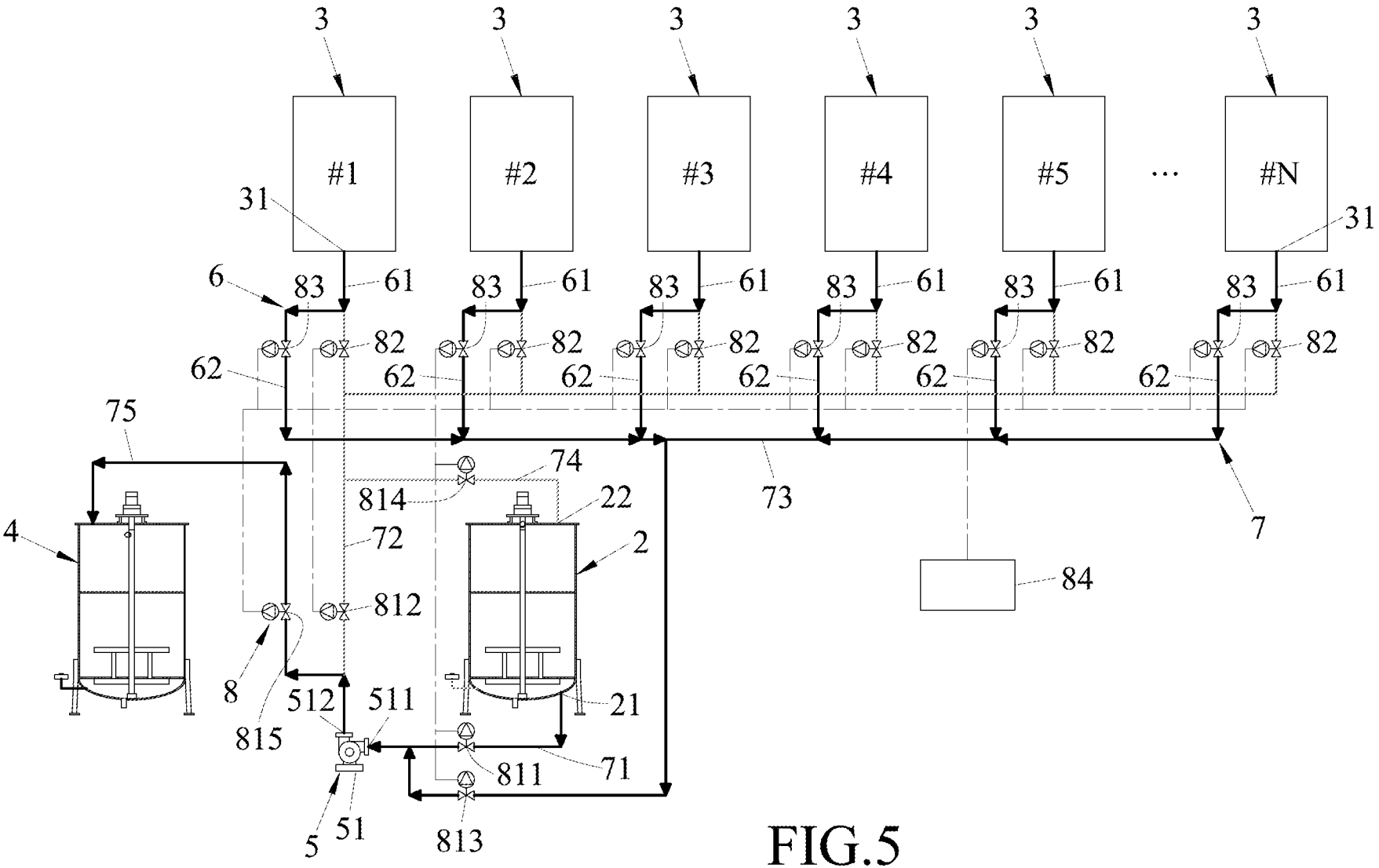
FIG. 5 is a schematic view illustrating the flow of a pulp in the first embodiment in a waste discharging state.
Figure 6:
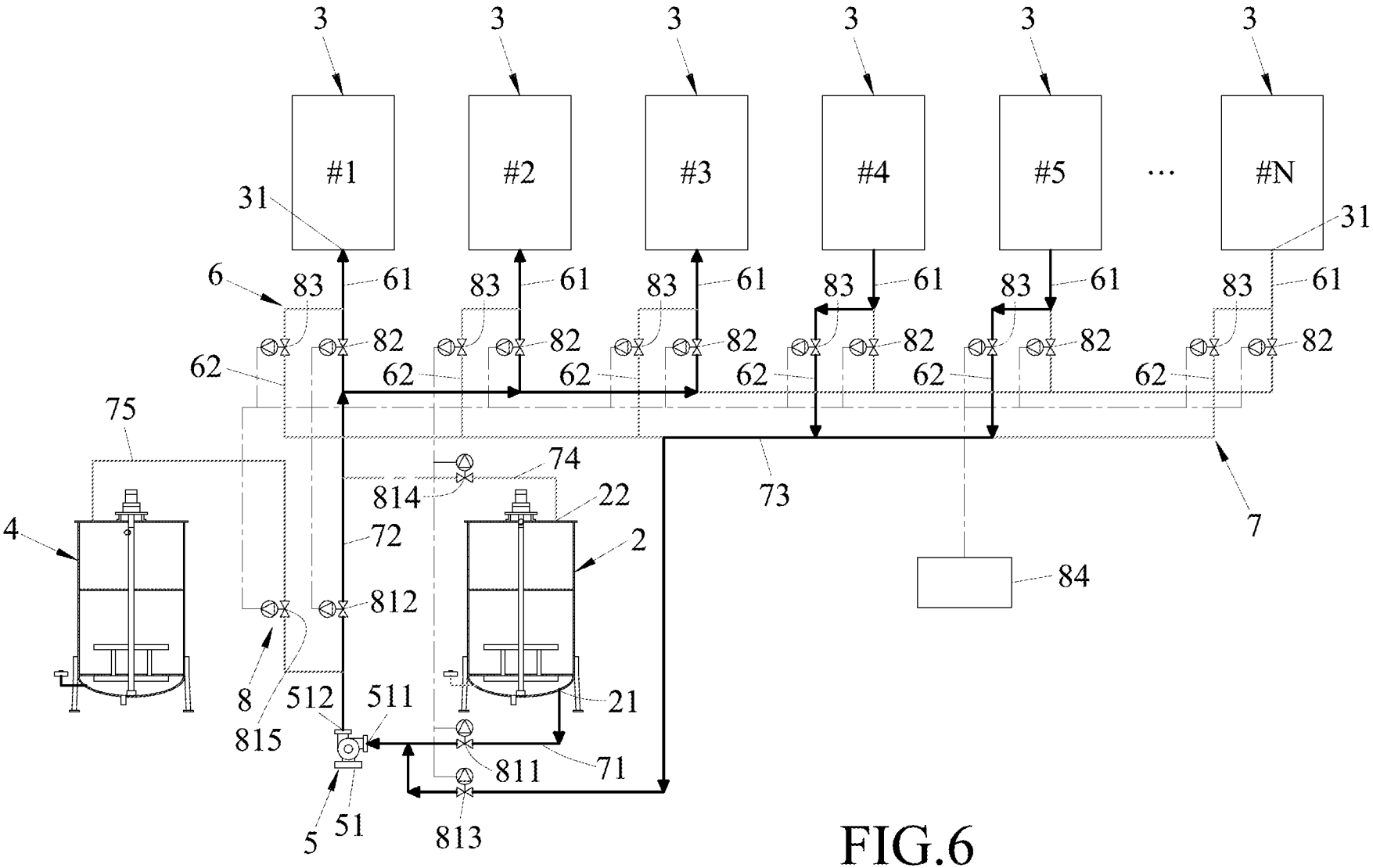
FIG. 6 is a schematic view illustrating the flow of a pulp in the first embodiment in a pulp-supply and pulp-return state.

The valve unit 8 is operable to control the flow of the pulp through each of the first pulp pipes 61 of the first pipe unit 6, the flow of the pulp through each of the second pulp pipes 62 of the first pipe unit 6, the flow of the pulp through the first pipe 71 of the second pipe unit 7, the flow of the pulp through the second pipe 72 of the second pipe unit 7, the flow of the pulp through the third pipe 73 of the second pipe unit 7, the flow of the pulp through the fourth pipe 74 of the second pipe unit 7, and the flow of the pulp through the fifth pipe 75 of the second pipe unit 7, such that the flow of the pulp is convertible among a pulp-supply state (see FIG. 3), in which the pulp flows out from the pulp supply machine 2 into at least one of the forming machines 3, a pulp-return state (see FIG. 4), in which the pulp flows out from at least one of the forming machines 3 into the pulp supply machine 2, a waste discharging state (see FIGS. 5 and 7), in which the pulp flows out from at least one of the pulp-supply machine 2 and the forming machines 3 into the waste disposal machine 4, and a pulp-supply and pulp-return state (see FIG. 6).

The valve unit 8 includes a plurality of first valves, a plurality of second valves 82, a plurality of third valves 83 and a control subunit 84.

In the first embodiment, the valve unit 8 includes five first valves 811, 812, 813, 814, 815 each of which is operable to convert between an open state, in which the first valve 811, 812, 813, 814, 815 permits the flow of the pulp through a respective one of the first pipe 71, the second pipe 72, the third pipe 73, the fourth pipe 74 and the fifth pipe 75 of the second pipe unit 7, and a closed state, in which the first valve 811, 812, 813, 814, 815 prevents the flow of the pulp through the respective one of the first pipe 71, the second pipe 72, the third pipe 73, the fourth pipe 74 and the fifth pipe 75. Specifically, in the first embodiment, the first valves 811, 812, 813, 814, 815 are respectively disposed on the first pipe 71, the second pipe 72, the third pipe 73, the fourth pipe 74 and the fifth pipe 75.

Each of the second valves 82 is operable to convert between an open state, in which the second valve 82 permits the flow of the pulp through a respective one of the first pulp pipes 61 of the first pipe unit 6, and a closed state, in which the second valve 82 prevents the flow of the pulp through the respective one of the first pulp pipes 61. Specifically, in the first embodiment, the second valves 82 are respectively disposed on the first pulp pipes 61.

Each of the third valves 83 is operable to convert between an open state, in which the third valve 83 permits the flow of the pulp through a respective one of the second pulp pipes 62 of the first pipe unit 6, and a closed state, in which the third valve 83 prevents the flow of the pulp through the respective one of the second pulp pipes 62. Specifically, in the first embodiment, the third valves 83 are respectively disposed on the second pulp pipes 62.

The control subunit 84 is operable to control each of the first valves 811, 812, 813, 814, 815, the second valves 82 and the third valves 83 to convert between the open state and the closed state.

In the first embodiment, the control subunit 84 is electrically coupled to the first valves 811, 812, 813, 814, 815, the second valves 82 and the third valves 83 and actuates the first valves 811, 812, 813, 814, 815, the second valves 82 and the third valves 83 electrically.

It is noted that, in certain embodiments, the first valves 811, 812, 813, 814, 815, the second valves 82 and the third valves 83 may be actuated by, but not limited to, a pneumatic power system therein, or an external force.

Exemplarily, the first embodiment transports the pulp among the pulp-supply machine 2, the waste disposal machine 4 and five forming machines 3 that are respectively named as the #1, #2, #3, #4 and #5 forming machines for convenience of description, and includes five second valves 82 and five third valves 83. It is noted that, the first embodiment may transport the pulp among N forming machines, and N is configured to be a positive integer.

Referring to FIGS. 2 and 3 again, in cooperation with Table 1 below, in which the valves that are in the open state are marked with a check, when the valve unit 8 is operated such that the flow of the pulp through the first pipe 71 and the second pipe 72 of the second pipe unit 7 is permitted (i.e., the first valves 811, 812 are controlled by the control subunit 84 to be in the open state), that the flow of the pulp through the third pipe 73, the fourth pipe 74 and the fifth pipe 75 of the second pipe unit 7 is prevented (i.e., the first valves 813, 814, 815 are controlled by the control subunit 84 to be in the closed state), that the second valves 82 are controlled by the control subunit 84 to be in the open state, and that the third valves 83 are controlled by the control subunit 84 to be in the closed state, the flow of the pulp is in the pulp-supply state, in which the pulp flows out from the pulp supply machine 2, sequentially through the first pipe 71, the first pump 51 of the pump unit 5, the second pipe 72 and the first pulp pipes 61 of the first pipe unit 6, into the forming machines 3 to which the first pulp pipes 61 are respectively connected.

TABLE 1

| Pulp-supply state (First embodiment) | | |
|---|---|---|
| | | Valve open |
| The first valve 811 | | V |
| The first valve 812 | | V |
| The first valve 813 | | |
| The first valve 814 | | |
| The first valve 815 | | |
| The second valve 82 on the first pulp pipe 61 connected to the forming machine | #1 | V |
| | #2 | V |
| | #3 | V |
| | #4 | V |
| | #5 | V |
| The third valve 83 on the second pulp pipe 62 connected to the forming machine | #1 | |
| | #2 | |
| | #3 | |
| | #4 | |
| | #5 | |

Referring to FIG. 4 again, in cooperation with Table 2 below, in which the valves that are in the open state are marked with a check, when the valve unit 8 is operated such that the flow of the pulp through the second pipe 72, the third pipe 73 and the fourth pipe 74 of the second pipe unit 7 is permitted (i.e., the first valves 812, 813, 814 are controlled by the control subunit 84 to be in the open state), that the flow of the pulp through the first pipe 71 and the fifth pipe 75 of the second pipe unit 7 is prevented (i.e., the first valves 811, 815 are controlled by the control subunit 84 to be in the closed state), that the second valves 82 of the valve unit 8 are controlled by the control subunit 84 to be in the closed state, and that the third valves 83 of the valve unit 8 are controlled by the control subunit 84 to be in the open state, the flow of the pulp is in the pulp-return state, in which the pulp flows out from the forming machines 3, sequentially through parts of the first pulp pipes 61 of the first pipe unit 6 to which the forming machines 3 are respectively connected, the second pulp pipes 62 of the first pipe unit 6 to which the first pulp pipes 61 are respectively connected, the third pipe 73, part of the first pipe 71, the first pump 51 of the pump unit 5, the second pipe 72 and the fourth pipe 74, into the pulp supply machine 2. When the flow of the pulp is kept in the pulp-return state, the pulp in the forming machines 3 will be removed from the forming machines 3. Afterwards, the molds in the forming machines 3 can be replaced.

TABLE 2

| Pulp-return state (First embodiment) | | |
|---|---|---|
| | | Valve open |
| The first valve 811 | | |
| The first valve 812 | | V |
| The first valve 813 | | V |
| The first valve 814 | | V |
| The first valve 815 | | |
| The second valve 82 on the first pulp pipe 61 connected to the forming machine | #1 | |
| | #2 | |
| | #3 | |
| | #4 | |
| | #5 | |
| The third valve 83 on the second pulp pipe 62 connected to the forming machine | #1 | V |
| | #2 | V |
| | #3 | V |
| | #4 | V |
| | #5 | V |

Referring to FIG. 5 again, in cooperation with Table 3 below, in which the valves that are in the open state are marked with a check, when the valve unit 8 is operated such that the flow of the pulp through the first pipe 71, the third pipe 73 and the fifth pipe 75 of the second pipe unit 7 is permitted (i.e., the first valves 811, 813, 815 are controlled by the control subunit 84 to be in the open state), that the flow of the pulp through the second pipe 72 and the fourth pipe 74 of the second pipe unit 7 is prevented (i.e., the first valves 812, 814 are controlled by the control subunit 84 to be in the closed state), that the second valves 82 of the valve unit 8 are controlled by the control subunit 84 to be in the closed state, and that the third valves 83 of the valve unit 8 are controlled by the control subunit 84 to be in the open state, the flow of the pulp is in the waste discharging state, in which the pulp flows out from the forming machines 3, sequentially through parts of the first pulp pipes 61 of the first pipe unit 6 to which the forming machines 3 are respectively connected, the second pulp pipes 62 of the first pipe unit 6 to which the first pulp pipes 61 are respectively connected, the third pipe 73, part of the first pipe 71, the first pump 51 of the pump unit 5, part of the second pipe 72 and the fifth pipe 75, into the waste disposal machine 4, and in which the pulp flows out from the pulp-supply machine 2, sequentially through the first pipe 71, the first pump 51, part of the second pipe 72 and the fifth pipe 75, into the waste disposal machine 4. When the flow of the pulp is kept in the waste discharging state, the pulp in the forming machines 3 and in the pulp-supply machine 2 will be removed from the forming machines 3 and the pulp-supply machine 2. Afterwards, the forming machines 3 and the pulp-supply machine 2 may be cleaned and filled with another batch of pulp.

TABLE 3

Waste discharging state (First embodiment)

| | | Valve open |
|---|---|---|
| The first valve 811 | | V |
| The first valve 812 | | |
| The first valve 813 | | V |
| The first valve 814 | | |
| The first valve 815 | | V |
| The second valve 82 on the | #1 | |
| first pulp pipe 61 | #2 | |
| connected to the forming | #3 | |
| machine | #4 | |
| | #5 | |
| The third valve 83 on the | #1 | V |
| second pulp pipe 62 | #2 | V |
| connected to the forming | #3 | V |
| machine | #4 | V |
| | #5 | V |

Referring to FIG. 6 again, in cooperation with Table 4 below, in which the valves that are in the open state are marked with a check, when the valve unit 8 is operated such that the flow of the pulp through the first pipe 71, the second pipe 72 and the third pipe 73 of the second pipe unit 7 is permitted (i.e., the first valves 811, 812, 813 are controlled by the control subunit 84 to be in the open state), that the flow of the pulp through the fourth pipe 74 and the fifth pipe 75 of the second pipe unit 7 is prevented (i.e., the first valves 814, 815 are controlled by the control subunit 84 to be in the closed state), that at least one of the second valves 82 of the valve unit 8 is in the open state while the other second valves 82 are in the closed state, and that at least one of the third valves 83 of the valve unit 8 connected to one of the forming machines 3 different from the forming machine(s) 3 to which the at least one of the second valves 82 is connected is in the open state while the other third valves 83 are in the closed state, the flow of the pulp is in the pulp-supply and pulp-return state, in which the pulp flows out from the pulp supply machine 2 and the forming machine(s) 3 to which the at least one of the third valves 83 is connected into the forming machine(s) 3 to which the at least one of the second valves 82 is connected. Specifically, in the first embodiment, the pulp flows out from the forming machines #4, #5, sequentially through parts of the first pulp pipes 61 that are respectively connected to the forming machines #4, #5, the second pulp pipes 62 that are respectively connected to the first pulp pipes 61 respectively connected to the forming machines #4, #5, the third pipe 73, part of the first pipe 1, the first pump 51, the second pipe 72, the first pulp pipes 61 that are respectively connected to the forming machines #1, #2, #3, into the forming machines #1, #2, #3, and flows out from the pulp-supply machine 2, sequentially the first pipe 1, the first pump 51, the second pipe 72, the first pulp pipes 61 that are respectively connected to the forming machines #1, #2, #3, into the forming machines #1, #2, #3. Therefore, the forming machines #1, #2, #3 can be used for the pulp forming process, while the pulp in the forming machines #4, #5 is removed from the forming machines #4, #5 so that the molds in the forming machines #4, #5 can be replaced.

TABLE 4

Pulp-supply and pulp-return state (First embodiment)

| | | Valve open |
|---|---|---|
| The first valve 811 | | V |
| The first valve 812 | | V |
| The first valve 813 | | V |
| The first valve 814 | | |
| The first valve 815 | | |
| The second valve 82 on the | #1 | V |
| first pulp pipe 61 | #2 | V |
| connected to the forming | #3 | V |
| machine | #4 | |
| | #5 | |
| The third valve 83 on the | #1 | |
| second pulp pipe 62 | #2 | |
| connected to the forming | #3 | |
| machine | #4 | V |
| | #5 | V |

It is noted that, when the flow of the pulp is in the waste discharging state, the pulp may only flow out of one of the forming machines 3.

Figure 7:
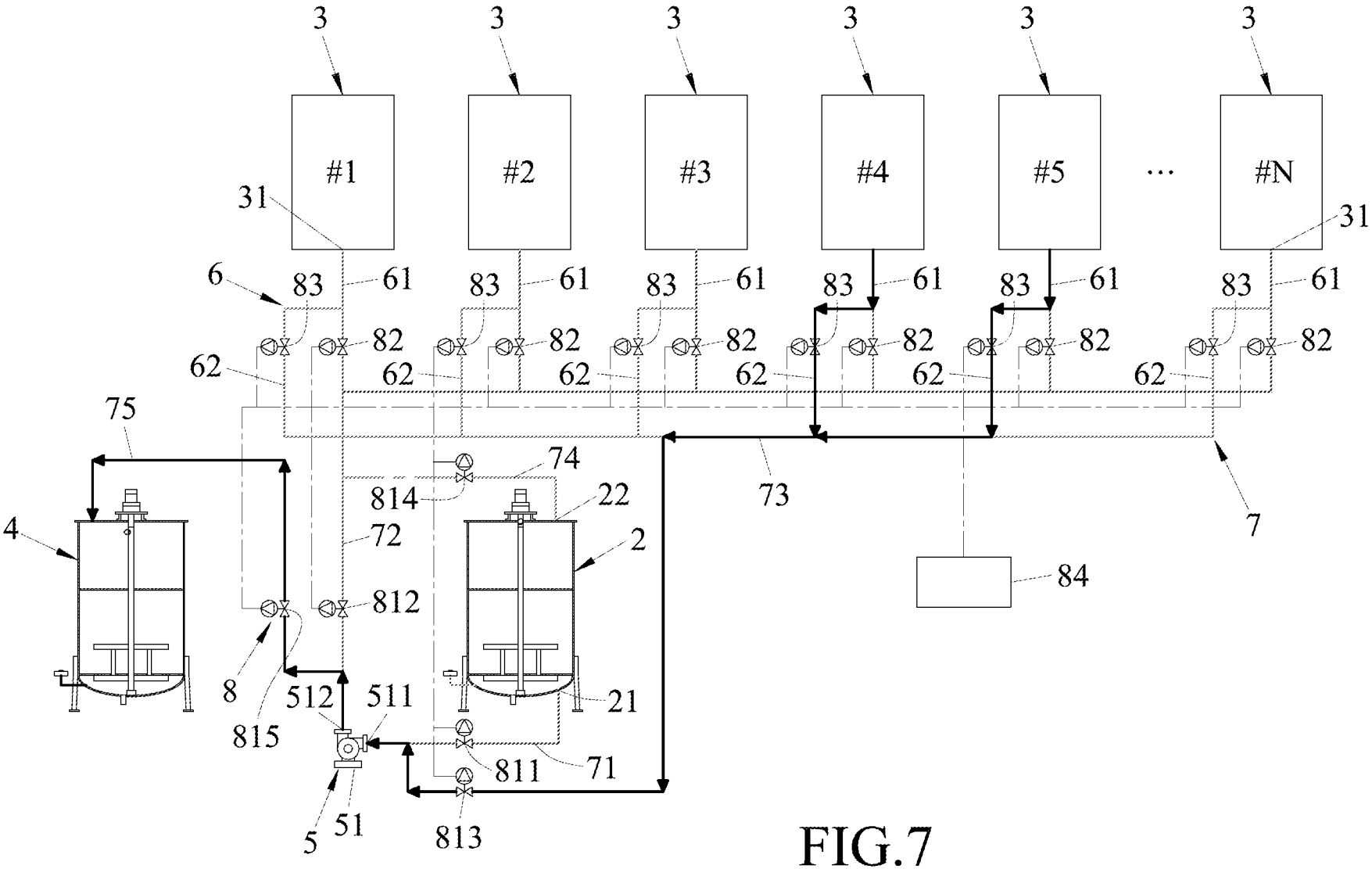
FIG. 7 is another schematic view illustrating the flow of a pulp in the first embodiment in the waste discharging state.

Exemplarily, referring to FIG. 7, in cooperation with Table 5 below, in which the valves that are in the open state are marked with a check, when the valve unit 8 is operated such that the flow of the pulp through the third pipe 73 and the fifth pipe 75 of the second pipe unit 7 is permitted (i.e., the first valves 813, 815 are controlled by the control subunit 84 to be in the open state), that the flow of the pulp through the first pipe 71, the second pipe 72 and the fourth pipe 74 of the second pipe unit 7 is prevented (i.e., the first valves 811, 812, 814 are controlled by the control subunit 84 to be in the closed state), that the second valves 82 of the valve unit 8 are controlled by the control subunit 84 to be in the closed state, that the third valves 83 of the valve unit 8 respectively connected to the forming machines #1, #2, #3 are controlled by the control subunit 84 to be in the closed state, and that the third valves 83 respectively connected to the forming machines #4, #5 are controlled by the control subunit 84 to be in the open state, the pulp flows out from the forming machines #4, #5, sequentially through parts of the first pulp pipes 61 of the first pipe unit 6 to which the forming machines #4, #5 are respectively connected, the second pulp pipes 62 of the first pipe unit 6 to which the first pulp pipes 61 are respectively connected, the third pipe 73, part of the first pipe 71, the first pump 51 of the pump unit 5, part of the second pipe 72 and the fifth pipe 75, into the waste disposal machine 4. Therefore, after the flow of the pulp is converted from the pulp-supply state into the waste discharging state, the pulp in the forming machines #4, #5 can be removed from the forming machines 3 while the forming machines #1, #2, #3 are in the pulp forming process. That is to say, even when the pulp in one of the forming machines 3 has to be removed or replaced, the pulp forming process in the rest of the forming machines 3 will not be affected.

TABLE 5

| Waste discharging state (First embodiment) | | |
|---|---|---|
| | | Valve open |
| The first valve 811 | | |
| The first valve 812 | | |
| The first valve 813 | | V |
| The first valve 814 | | |
| The first valve 815 | | V |
| The second valve 82 on the first pulp pipe 61 connected to the forming machine | #1 | |
| | #2 | |
| | #3 | |
| | #4 | |
| | #5 | |
| The third valve 83 on the second pulp pipe 62 connected to the forming machine | #1 | |
| | #2 | |
| | #3 | |
| | #4 | V |
| | #5 | V |

Figure 8:
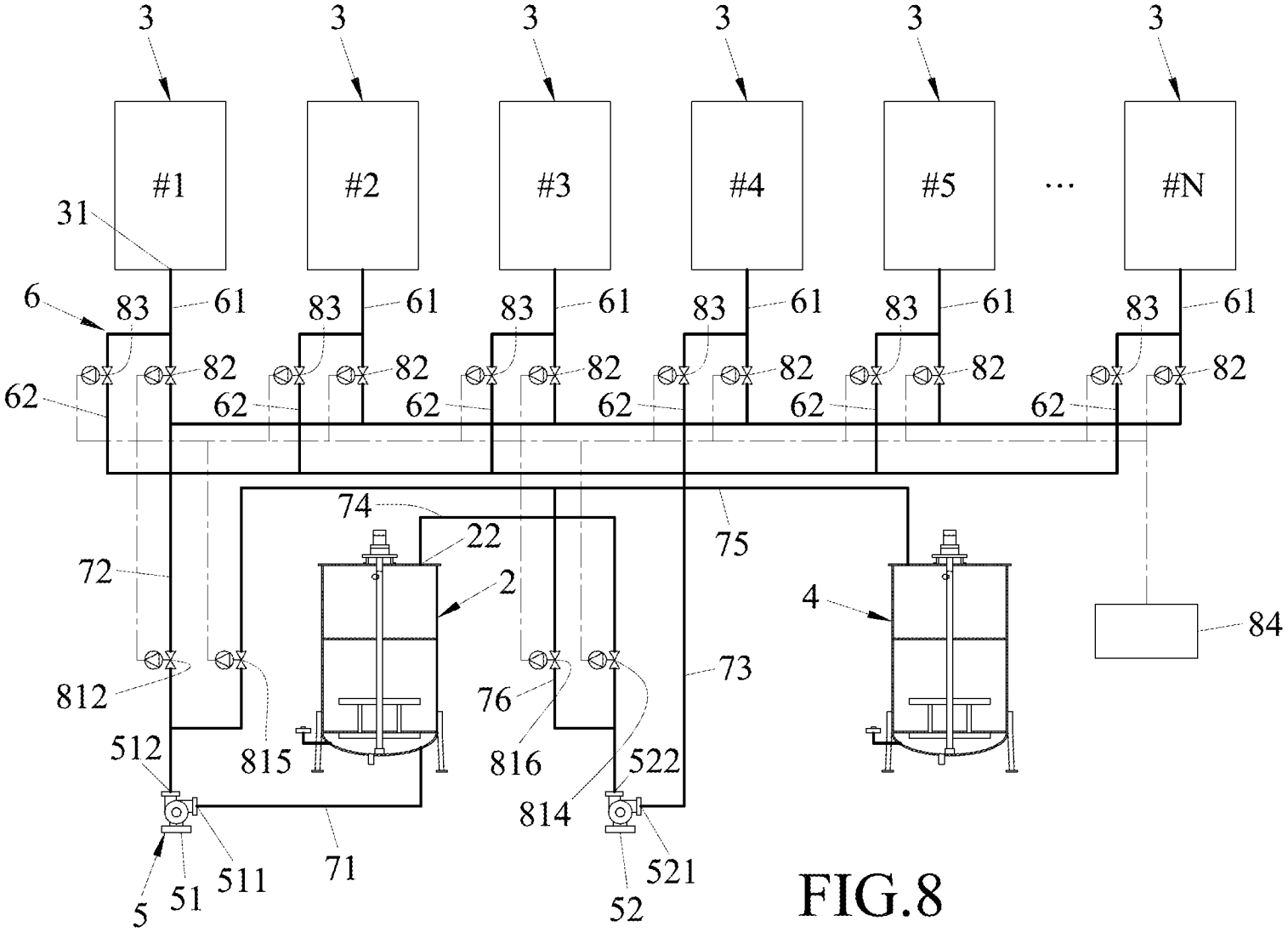
FIG. 8 is a schematic view of a second embodiment of the pulp transportation system according to the disclosure.

Referring further to FIG. 8, a second embodiment of the pulp transportation system according to the disclosure is similar to the first embodiment. Differences between the first embodiment and the second embodiment are that the pump unit 5 further includes a second pump 52, that the second pipe unit 7 further includes a sixth pipe 76, that the valve unit 8 further includes a first valve 816, and that the first valves 811, 813 are omitted.

The second pump 52 has a pump inlet 521 that is connected to the third pipe 73 of the second pipe unit 7, and a pump outlet 522 that is connected to the fourth pipe 74 of the second pipe unit 7.

The fifth pipe 75 of the second pipe unit 7 interconnects the second pipe 72, the fourth pipe 74 and the waste disposal machine 4. Specifically, the sixth pipe 76 is connected between the fifth pipe 75 and the fourth pipe 74 so that the fifth pipe 75 interconnects the second pipe 72, the fourth pipe 74 and the waste disposal machine 4.

The first valve 816 is operable to convert between an open state, in which the first valve 816 permits the flow of the pulp through the sixth pipe 76, and a closed state, in which the first valve 816 prevents the flow of the pulp through the sixth pipe 76.

Referring further to Table 6 below, in which the valves that are in the open state in each of the states of the flow of the pulp are marked with a check, the second pump 52 of the pump unit 5 is adapted for urging the pulp to flow and increasing the pressure in the flow of the pulp, and the flow of the pulp in the second embodiment is convertible among the pulp-supply state, the pulp-return state, the waste discharging state, the pulp-supply and pulp-return state and a pulp-supply and waste discharging state. When the flow of the pulp is in the pulp-return state, the pulp flows out from the forming machines 3, sequentially through parts of the first pulp pipes 61 of the first pipe unit 6 to which the forming machines 3 are respectively connected, the second pulp pipes 62 of the first pipe unit 6 to which the first pulp pipes 61 are respectively connected, the third pipe 73, the second pump 52 and the fourth pipe 74, into the pulp supply machine 2.

When the flow of the pulp is in the waste discharging state, the pulp flows out from the forming machines 3, sequentially through parts of the first pulp pipes 61 of the first pipe unit 6 to which the forming machines 3 are respectively connected, the second pulp pipes 62 of the first pipe unit 6 to which the first pulp pipes 61 are respectively connected, the third pipe 73, the second pump 52, part of the fourth pipe 74, the sixth pipe 76, part of the fifth pipe 75, into the waste disposal machine 4, and flows out from the pulp-supply machine 2, sequentially through the first pipe 71, the first pump 51, part of the second pipe 72 and the fifth pipe 75, into the waste disposal machine 4.

When the flow of the pulp is in the pulp-supply and pulp-return state, the pulp flows out from the pulp supply machine 2, sequentially through the first pipe 71, the first pump 51, the second pipe 72 and the first pulp pipes 61 of the first pipe unit 6, into the forming machines #1, #2, #3, and the pulp flows out from the forming machines #4, sequentially through parts of the first pulp pipes 61 of the first pipe unit 6 to which the forming machines #4, #5 are respectively connected, the second pulp pipes 62 of the first pipe unit 6 to which the first pulp pipes 61 are respectively connected, the third pipe 73, the second pump 52 and the fourth pipe 74, into the pulp supply machine 2.

When the flow of the pulp is in the pulp-supply and waste discharging state, the pulp flows out from the pulp supply machine 2, sequentially through the first pipe 71, the first pump 51, the second pipe 72 and the first pulp pipes 61 of the first pipe unit 6, into the forming machines #1, #2, #3, and the pulp flows out from the forming machines #4, #5, sequentially through parts of the first pulp pipes 61 of the first pipe unit 6 to which the forming machines #4, #5 are respectively connected, the second pulp pipes 62 of the first pipe unit 6 to which the first pulp pipes 61 are respectively connected, the third pipe 73, the second pump 52, part of the fourth pipe 74, the sixth pipe 76 and part of the fifth pipe 75, into the waste disposal machine 4.

Therefore, the second embodiment provides various states to the flow of the pulp.

TABLE 6

| | | Valve open |
|---|---|---|
| Pulp-supply state (Second embodiment) | | |
| The first valve 812 | | V |
| The first valve 814 | | |
| The first valve 815 | | |
| The first valve 816 | | |
| The second valve 82 on the first pulp pipe 61 connected to the forming machine | #1 | V |
| | #2 | V |
| | #3 | V |
| | #4 | V |
| | #5 | V |
| The third valve 83 on the second pulp pipe 62 connected to the forming machine | #1 | |
| | #2 | |
| | #3 | |
| | #4 | |
| | #5 | |
| Pulp-return state (Second embodiment) | | |
| The first valve 812 | | |
| The first valve 814 | | V |
| The first valve 815 | | |
| The first valve 816 | | |
| The second valve 82 on the first pulp pipe 61 | #1 | |
| | #2 | |

TABLE 6-continued

| | | Valve open |
|---|---|---|
| connected to the forming machine | #3 | |
| | #4 | |
| | #5 | |
| The third valve 83 on the second pulp pipe 62 connected to the forming machine | #1 | V |
| | #2 | V |
| | #3 | V |
| | #4 | V |
| | #5 | V |
| Waste discharging state (Second embodiment) | | |
| The first valve 812 | | |
| The first valve 814 | | |
| The first valve 815 | | V |
| The first valve 816 | | V |
| The second valve 82 on the first pulp pipe 61 connected to the forming machine | #1 | |
| | #2 | |
| | #3 | |
| | #4 | |
| | #5 | |
| The third valve 83 on the second pulp pipe 62 connected to the forming machine | #1 | V |
| | #2 | V |
| | #3 | V |
| | #4 | V |
| | #5 | V |
| Pulp-supply and pulp-return state (Second embodiment) | | |
| The first valve 812 | | V |
| The first valve 814 | | V |
| The first valve 815 | | |
| The first valve 816 | | |
| The second valve 82 on the first pulp pipe 61 connected to the forming machine | #1 | V |
| | #2 | V |
| | #3 | V |
| | #4 | |
| | #5 | |
| The third valve 83 on the second pulp pipe 62 connected to the forming machine | #1 | |
| | #2 | |
| | #3 | |
| | #4 | V |
| | #5 | V |
| Pulp-supply and waste discharging state (Second embodiment) | | |
| The first valve 812 | | V |
| The first valve 814 | | |
| The first valve 815 | | |
| The first valve 816 | | V |
| The second valve 82 on the first pulp pipe 61 connected to the forming machine | #1 | V |
| | #2 | V |
| | #3 | V |
| | #4 | |
| | #5 | |
| The third valve 83 on the second pulp pipe 62 connected to the forming machine | #1 | |
| | #2 | |
| | #3 | |
| | #4 | V |
| | #5 | V |

Figure 9:
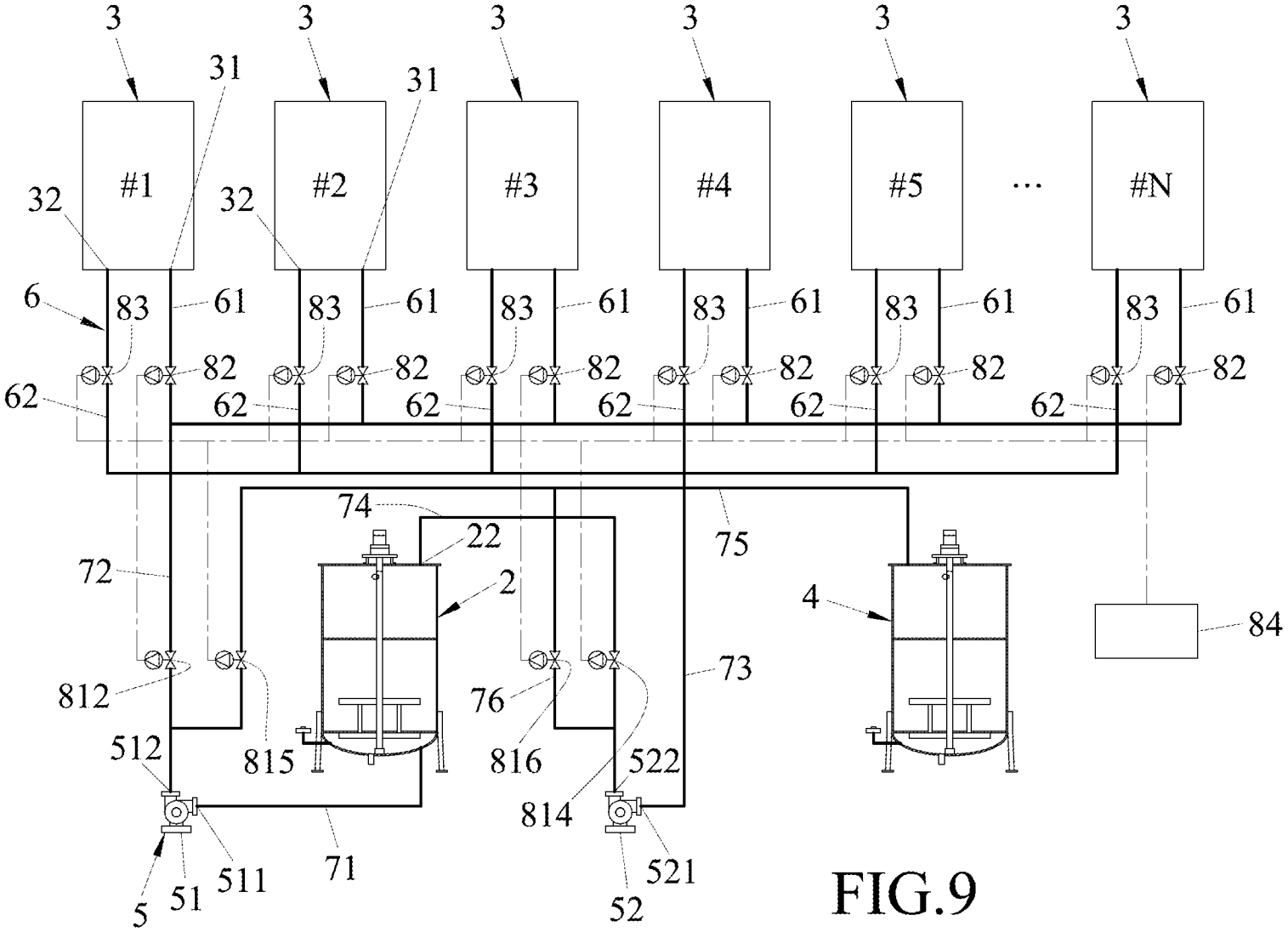
FIG. 9 is a schematic view of a modification of the second embodiment.

Referring further to FIG. 9, it is noted that, in one embodiment, each of the forming machines 3 further has a forming outlet 32. The first pulp pipes 61 of the first pipe unit 6 are respectively connected to the forming openings 31 of the forming machines 3. The second pulp pipes 62 are respectively connected to the forming outlets 32 of the forming machines 3. The flow of the pulp is convertible among the pulp-supply state, the pulp-return state, the pulp-supply and pulp-return state and the pulp-supply and waste discharging state.

According to the abovementioned description, benefits of the abovementioned embodiments can be analyzed and listed as below:

a) By virtue of the valve unit 8 controlling the flow of the pulp, the pulp flows through the first pipe unit 6 and the second pipe unit 7 in different directions among the pulp-supply machine 2, the forming machines 3 and the waste disposal machine 4 when the flow of the pulp is converted among various states. In comparison with conventional pulp transportation systems (e.g., the conventional pulp tank structure 1 mentioned in the background) that permit the pulp to flow through pipes in only one direction, the structure of each of the embodiments is simplified and relatively space-saving, which may achieve cost reduction and increase productive efficiency.

b) Even when the second pump 52 of the pump unit 5 is omitted, the flow of the pulp is still convertible among different states by the first pump 51 of the pump unit 5, which further reduces the cost for transportation of the pulp in each of the embodiments.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A pulp transportation system adapted for transporting a pulp among a pulp-supply machine and a plurality of forming machines, said pulp transportation system comprising:

a pump unit adapted for urging the pulp to flow;

a first pipe unit adapted for fluidly communicating with the forming machines, and including a plurality of first pulp pipes and a plurality of second pulp pipes that are adapted for the pulp to flow therethrough, said first pulp pipes being respectively connected to the forming machines, said second pulp pipes being respectively connected to the forming machines;

a second pipe unit adapted for the pulp to flow therethrough and including a first pipe that is adapted for interconnecting a pulp-supply outlet of the pulp-supply machine and said pump unit, a second pipe that fluidly communicates said pump unit with said first pulp pipes of said first pipe unit, a third pipe that fluidly communicates said pump unit with said second pulp pipes of said first pipe unit, and a fourth pipe that is adapted for interconnecting a pulp-supply inlet of the pulp-supply machine and said third pipe; and a valve unit operable to control the flow of the pulp through each of said first pulp pipes of said first pipe unit, the flow of the pulp through each of said second pulp pipes of said first pipe unit, the flow of the pulp through said first pipe of said second pipe unit, the flow of the pulp through said second pipe of said second pipe unit, the flow of the pulp through said third pipe of said second pipe unit, and the flow of the pulp through said fourth pipe of said second pipe unit, such that the flow of the pulp is convertible between a pulp-supply state, in which the pulp flows out from the pulp supply machine into at least one of the forming machines, and a pulp-return state, in which the pulp flows out from at least one of the forming machines into the pulp supply machine.

2. The pulp transportation system as claimed in claim 1, further adapted for transporting the pulp to a waste disposal machine, wherein:

said second pipe unit further includes a fifth pipe that is adapted for fluidly communicating the waste disposal machine with said first pipe and said third pipe; and said valve unit is operable to control the flow of the pulp through said fifth pipe, such that the flow of the pulp is convertible among the pulp-supply state, the pulp-return state, and a waste discharging state, in which the pulp flows out from at least one of the pulp-supply machine and the forming machines into the waste disposal machine.

3. The pulp transportation system as claimed in claim 2, wherein said valve unit includes a plurality of first valves each of which is operable to convert between an open state, in which said first valve permits the flow of the pulp through a respective one of said second pipe, said fourth pipe and said fifth pipe of said second pipe unit, and a closed state, in which said first valve prevents the flow of the pulp through the respective one of said second pipe, said fourth pipe and said fifth pipe, a plurality of second valves each of which is operable to convert between an open state, in which said second valve permits the flow of the pulp through a respective one of said first pulp pipes of said first pipe unit, and a closed state, in which said second valve prevents the flow of the pulp through the respective one of said first pulp pipes, and a plurality of third valves each of which is operable to convert between an open state, in which said third valve permits the flow of the pulp through a respective one of said second pulp pipes of said first pipe unit, and a closed state, in which said third valve prevents the flow of the pulp through the respective one of said second pulp pipes.

4. The pulp transportation system as claimed in claim 3, wherein said valve unit further includes a control subunit that is operable to control each of said first valves, said second valves and said third valves to convert between the open state and the closed state.

5. The pulp transportation system as claimed in claim 3, wherein when said valve unit is operated such that the flow of the pulp through said first pipe and said second pipe of said second pipe unit is permitted, that the flow of the pulp through said third pipe, said fourth pipe and said fifth pipe of said second pipe unit is prevented, that said second valves of said valve unit are in the open state, and that said third valves of said valve unit are in the closed state, the flow of the pulp is in the pulp-supply state, in which the pulp flows out from the pulp supply machine, sequentially through said first pipe, said second pipe and at least one of said first pulp pipes of said first pipe unit, into the at least one of the forming machines to which the at least one of said first pulp pipes is connected.

6. The pulp transportation system as claimed in claim 3, wherein when said valve unit is operated such that the flow of the pulp through said third pipe and said fourth pipe of said second pipe unit is permitted, that the flow of the pulp through said first pipe and said fifth pipe of said second pipe unit is prevented, that said second valves of said valve unit are in the closed state, and that said third valves of said valve unit are in the open state, the flow of the pulp is in the pulp-return state, in which the pulp flows out from the at least one of the forming machines, sequentially through at least one of said second pulp pipes of said first pipe unit to which the at least one of the forming machines is connected, said third pipe and said fourth pipe, into the pulp supply machine.

7. The pulp transportation system as claimed in claim 3, wherein when said valve unit is operated such that the flow of the pulp through said first pipe, said second pipe and said third pipe of said second pipe unit is permitted, that the flow of the pulp through said fourth pipe and said fifth pipe of said second pipe unit is prevented, that at least one of said second valves of said valve unit is in the open state while the other second valves are in the closed state, and that at least one of said third valves of said valve unit connected to a forming machine different from the forming machine to which the at least one of said second valves is connected is in the open state while the other third valves are in the closed state, the flow of the pulp is in a pulp-supply and pulp-return state, in which the pulp flows out from the forming machine to which the at least one of said third valves is connected and the pulp supply machine into the forming machine to which the at least one of said second valves is connected.

8. The pulp transportation system as claimed in claim 3, wherein when said valve unit is operated such that the flow of the pulp through said first pipe, said third pipe and said fifth pipe of said second pipe unit is permitted, that the flow of the pulp through said second pipe and said fourth pipe of said second pipe unit is prevented, that said second valves of said valve unit are in the closed state, and that said third valves of said valve unit are in the open state, the flow of the pulp is in the waste discharging state, in which the pulp flows out from the forming machines, through said second pulp pipes of said first pipe unit, said third pipe and said fifth pipe, into the waste disposal machine.

9. The pulp transportation system as claimed in claim 8, wherein:

said pump unit includes a first pump that has a pump inlet connected to said first pipe of said second pipe unit, and a pump outlet connected to said second pipe of said second pipe unit;

said third pipe of said second pipe unit interconnects said first pipe and said second pulp pipes of said first pipe unit so that said third pipe fluidly communicates said pump unit with said second pulp pipes;

said fifth pipe of said second pipe unit interconnects said second pipe and the waste disposal machine so that said fifth pipe fluidly communicates with the waste disposal machine and said pumping unit;

when the flow of the pulp is in the pulp-return state, the pulp flows out from the at least one of the forming machines, sequentially through said third pipe, said first pump and said second pipe, into the pulp supply machine; and when the flow of the pulp is in the waste discharging state, the pulp flows out from the forming machines, sequentially through said third pipe, said first pump, said second pipe and said fifth pipe, into the waste disposal machine.

10. The pulp transportation system as claimed in claim 8, wherein:

said pump unit includes a first pump that has a pump inlet connected to said first pipe of said second pipe unit, and a pump outlet connected to said second pipe of said second pipe unit;

said third pipe of said second pipe unit interconnects said first pipe and said second pulp pipes of said first pipe unit so that said third pipe fluidly communicates said pump unit with said second pulp pipes;

said fifth pipe of said second pipe unit interconnects said second pipe and the waste disposal machine so that said fifth pipe fluidly communicates with the waste disposal machine and said pumping unit;

when the flow of the pulp is in the pulp-return state, the pulp flows out from the at least one of the forming machines, sequentially through said third pipe, said first pump and said second pipe, into the pulp supply machine; and when the flow of the pulp is in the waste discharging state, the pulp further flows out from the pulp-supply machine, sequentially through said first pipe, said first pump, said second pipe and said fifth pipe, into the waste disposal machine.

11. The pulp transportation system as claimed in claim 8, wherein:

said pump unit includes a first pump that has a pump inlet connected to said first pipe of said second pipe unit, and a pump outlet connected to said second pipe of said second pipe unit, and a second pump that has a pump inlet connected to said third pipe of said second pipe unit, and a pump outlet connected to said fourth pipe of said second pipe unit;

said fifth pipe of said second pipe unit interconnects said second pipe, said fourth pipe and the waste disposal machine;

when the flow of the pulp is in the pulp-return state, the pulp flows out from the at least one of the forming machines, sequentially through said third pipe, said second pump and said fourth pipe, into the pulp supply machine; and when the flow of the pulp is in the waste discharging state, the pulp flows out from the forming machines, sequentially through said third pipe, said second pump, said fourth pipe and said fifth pipe, into the waste disposal machine.

12. The pulp transportation system as claimed in claim 8, wherein:

said pump unit includes a first pump that has a pump inlet connected to said first pipe of said second pipe unit, and a pump outlet connected to said second pipe of said second pipe unit, and a second pump that has a pump inlet connected to said third pipe of said second pipe unit, and a pump outlet connected to said fourth pipe of said second pipe unit;

said fifth pipe of said second pipe unit interconnects said second pipe, said fourth pipe and the waste disposal machine;

when the flow of the pulp is in the pulp-return state, the pulp flows out from the at least one of the forming machines, sequentially through said third pipe, said second pump and said fourth pipe, into the pulp supply machine; and when the flow of the pulp is in the waste discharging state, the pulp further flows out from the pulp-supply machine, sequentially through said first pipe, said first pump, said second pipe and said fifth pipe, into the waste disposal machine.

13. The pulp transportation system as claimed in claim 1, wherein said second pulp pipes are respectively connected to said first pulp pipes so that said second pulp pipes are respectively connected to the forming machines respectively via said first pulp pipes.

14. The pulp transportation system as claimed in claim 1, wherein said first pulp pipes are respectively and directly connected to the forming machines, and said second pulp pipes are respectively and directly connected to the forming machines.

15. A pulp transportation system adapted for transporting a pulp between a pulp-supply machine and at least one forming machine, said pulp transportation system comprising:

a pump unit adapted for urging the pulp to flow;

at least one first pipe unit including a first pulp pipe that is connected to a forming opening of the at least one forming machine, and a second pulp pipe that is connected to said first pulp pipe;

a second pipe unit adapted for the pulp to flow therethrough and including a first pipe that is adapted for interconnecting a pulp-supply outlet of the pulp-supply machine and said pump unit, a second pipe that fluidly communicates said pump unit with said first pulp pipe of said at least one first pipe unit, a third pipe that fluidly communicates said pump unit with said second pulp pipe of said at least one first pipe unit, and a fourth pipe that is adapted for interconnecting a pulp-supply inlet of the pulp-supply machine and said third pipe; and a valve unit operable to control the flow of the pulp through said first pulp pipe of said at least one first pipe unit, the flow of the pulp through said second pulp pipe of said at least one first pipe unit, the flow of the pulp through said first pipe of said second pipe unit, the flow of the pulp through said second pipe of said second pipe unit, the flow of the pulp through said third pipe of said second pipe unit, and the flow of the pulp through said fourth pipe of said second pipe unit, such that the flow of the pulp is convertible between a pulp-supply state, in which the pulp flows out from the pulp supply machine into the at least one forming machine, and a pulp-return state, in which the pulp flows out from the at least one forming machine into the pulp supply machine.

* * * * *